United States Patent [19]

Consoli

[11] Patent Number: 4,763,888

[45] Date of Patent: Aug. 16, 1988

[54] FLAT MAIL COLLATOR

[76] Inventor: Michael F. Consoli, 2508 Avalon Pl., Adelphi, Md. 20783-2745

[21] Appl. No.: 4,560

[22] Filed: Jan. 20, 1987

[51] Int. Cl.[4] ..... B65H 39/02; B42F 17/00

[52] U.S. Cl. ..... 270/58; 211/11

[58] Field of Search ..... 270/58; 211/10, 11

[56] References Cited

U.S. PATENT DOCUMENTS

| | | | |
|---|---|---|---|
| 730,562 | 1/1903 | Parks et al. . | |
| 744,350 | 11/1903 | Jewel . | |
| 764,299 | 7/1904 | Marsh . | |
| 807,084 | 12/1905 | Muller | 211/11 |
| 1,439,793 | 12/1922 | Casey . | |
| 1,682,667 | 8/1928 | Eifel . | |
| 1,881,614 | 10/1932 | Irving | 211/11 |
| 1,966,555 | 7/1934 | Le Febvre | 211/11 |
| 2,249,265 | 7/1941 | Bauder . | |
| 2,261,806 | 11/1941 | Hills | 211/11 |
| 2,485,519 | 10/1949 | Wardy | 211/11 |
| 2,626,610 | 1/1953 | McTavish et al. | 211/11 |
| 2,765,925 | 10/1956 | Raach, Sr. . | |
| 2,876,907 | 3/1959 | Amberg . | |
| 2,927,585 | 3/1960 | Rosan | 211/11 |
| 3,000,509 | 9/1961 | Larter . | |
| 3,869,045 | 3/1975 | Lear | 211/11 |
| 3,948,395 | 4/1976 | Thornton . | |
| 4,390,100 | 6/1983 | Petron . | |

FOREIGN PATENT DOCUMENTS

| | | | |
|---|---|---|---|
| 47461 | 6/1933 | Denmark | 211/11 |
| 134116 | 7/1929 | Switzerland | 211/11 |
| 350667 | 1/1961 | Switzerland | 211/11 |
| 217105 | 6/1924 | United Kingdom | 211/11 |

*Primary Examiner*—Eugene H. Eickholt

*Attorney, Agent, or Firm*—David B. Newman, Jr. & Associates

[57] ABSTRACT

A flat mail collator is provided having a flat base with a rectangular shape and a handle connected to the flat support. A plurality of leaves having a rectangular shape are connected to the flat base for defining spaces between the adjacent ones of the leaves. The plurality of leaves are coded for a plurality of addresses for sorting mail by address by inserting individual pieces of mail between these. Upon completion of the sorting operation, the mail is removed from the leaves by the lifting the flat base by the handles and tilting the flat base and allowing the sorted mail to slip from between the leaves and remain sorted.

3 Claims, 2 Drawing Sheets

Fig. 3
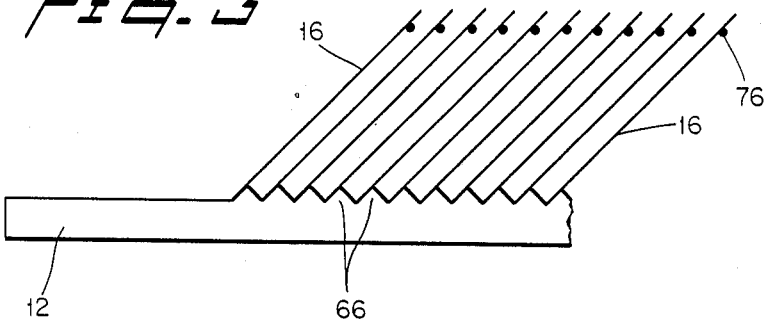
Fig. 4
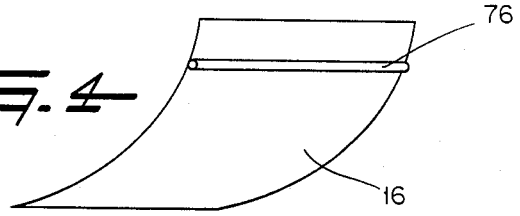
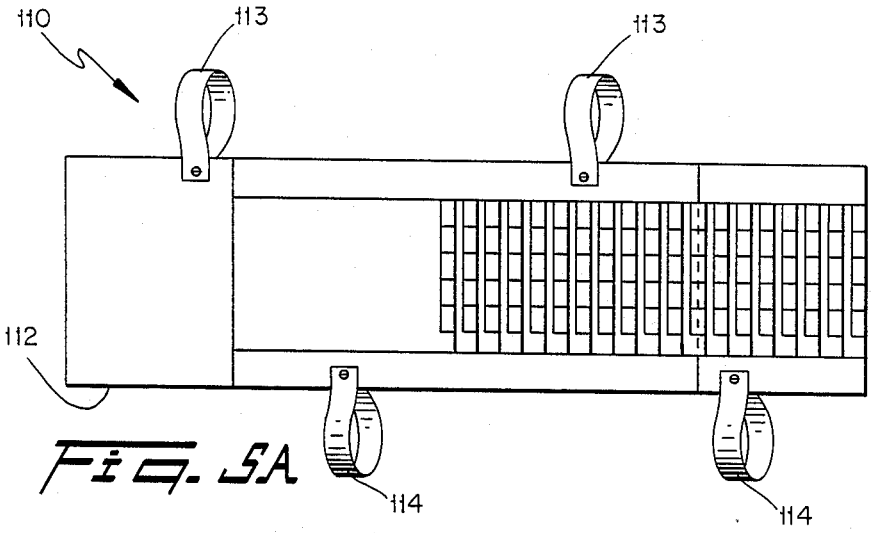
Fig. 5A
Fig. 5B
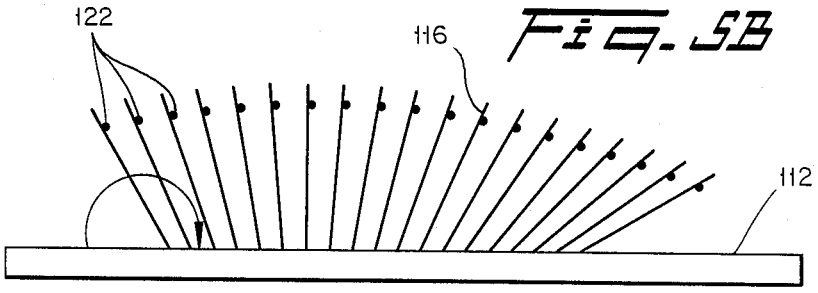

FLAT MAIL COLLATOR

BACKGROUND OF THE INVENTION

This invention relates to a flat mail collator for sorting mail larger than letter size including magazines, newspapers, manila envelopes, advertisement circulars or the like.

DESCRIPTION OF THE PRIOR ART

Sorting aids and mail sorters are well known in the prior art. For example, U.S. Pat. No. 4,390,100 to Petron discloses a mail sorter made from a plurality of identioal leaves, each coded to one or more addresses with flexible and expandable bellows binding joining the leaves into a book. The leaves may be arranged on a flat surface in staggered, stair step, offset fashion for sorting of mail by inserting individual mail pieces between the leaves. The leaves may be gathered into superposed relationship and turned to a vertical orientation with the mail between the leaves, and whereupon a resultant neat stack of sorted, superposed mail pieces may be removed from the mail sorter book. A problem with this mail sorter is that in operation, it is time consuming and difficult for a mail sorting person to operate and removing mail from this mail sorter is very difficult. This mail sorter cannot be used with 35 pounds of mail.

U.S. Pat. No. 2,765,925 to Raach, discloses a sorter aid for use in sorting alphabetically, numerically classifiable documents. This particular sorting aid includes a plurality of elongated, polygonal divider tabs mounted at their lower most and forward most ends to the upper surface of support by any suitable fastening means, preferably stables. While advantageous for use in sorting alphabetical or numerically arranged classifiable documents, this particular sorting aid has disadvantages in operation in a postal environment in that the tabs include pairs of polygonal divider tabs with a first polygonal divider tab superimposed upon a second polygonal divider tab and in partial overlapping relationship thereto. This particular embodiment of a sorter does not allow one to have multi-coded sets of indicia, so that a single sorter may be used to repetitively sort mail by address, for a number of streets, buildings, etc. A problem with this sorter aid is that the leaves are bounded at one end and have variable lengths, which makes this sorter aid difficult to use because mail is pushed in farther than required and gets stuck between the leaves.

Thus, in the prior art, sorters developed to date have been either difficult to use for sorting mail, or not adaptable directly for sorting mail.

OBJECTS AND SUMMARY OF THE INVENTION

An object of the present invention is to provide a flat mail collator for facilitating the sorting of mail including magazines, newspapers, manila envelopes, advertisement circulars or the like.

Another object of the present invention is to provide a flat mail collator which is easy to use by an operator.

A further object of the present invention is to provide a flat mail collator which is easy and efficient to use.

According to the present invention, as embodied and broadly described herein, a flat mail collator is provided having a flat base, handle means and a plurality of leaves connected to the flat support, and a narrow strip attached near the open end of each of the leaves. The flat base has a rectangular shape with an outer width and first and second length edges wherein first and second length edges are along the outer dimension of the flat support. This flat base also may include a margin along the first length edge. The handle means may be embodied as a handle, for example, as a leather strap connected in a loop to the flat support. The handle can be connected along the margin of the flat support.

The leaves are made from a flexible material and are permanently attached to the flat support. The plurality of leaves defines spaces between the adjacent ones of the plurality of leaves, and they are typically coded for a plurality of addresses for sorting mail by address by inserting individual pieces of mail between the leaves. Upon completion of the sorting operation, the mail is removed from the plurality of leaves by lifting the flat base by the handle and tilting the flat base along the second length edge of the flat base allowing the sorted mail to slip from between the leaves and remain in a sorted position. The narrow strip attached near the open end of each of the leaves elevates each of the leaves slightly to facilitate lifting each of the leaves during the sorting operation.

Additional objects and advantages of the invention will be set forth in the description which follows, and in part will be obvious from the description, or may be learned by practice of the invention.

BRIEF DESCRIPTION OF THE DRAWINGS

The accompanying drawings, which are incorporated in and constitute part of this specification, illustrate a preferred embodiment of the invention, and together with the description, serve to explain the principles of the invention.

FIG. 3 shows a flat base having ridges to provide built in give;

FIG. 4 shows a narrow strip attached to each of the leaves; and

FIGS. 5A and 5B depict a flat mail collator according to the second embodiment of the present invention.

DETAILED DECRIPTION OF THE PREFERRED EMBODIMENTS

Reference will now be made in detail to the present preferred embodiments of the invention, examples of which are illustrated in the accompanying drawings.

Figure 1A:
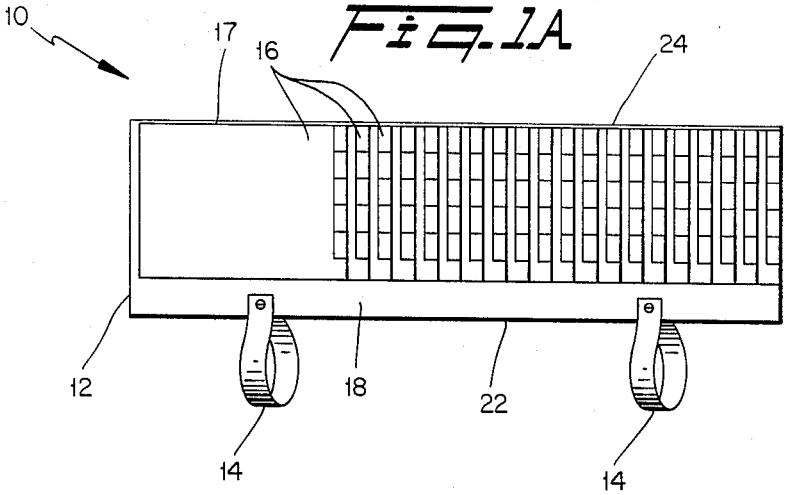
FIGS. 1A and 1B pictorially depict a flat mail collator for sorting mail according to the present invention.
Figure 1B:
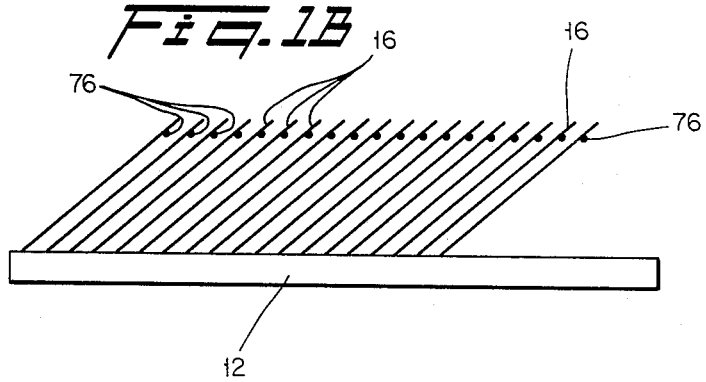

Referring to FIGS. 1A and 1B a preferred embodiment of a flat mail collator 10 is shown, comprising a flat base 12, handle means, a plurality of leaves 16 and a narrow strip 76. The handle means may be embodied as a handle 14, which is pictorially shown as a leather strap handle afixed to flat base 12. The flat base 12 is made from a hard yet flexible material.

The flat base 12 has a rectangular shape with an outer width and first and second length edges 22, 24. The first and second length edges 22, 24 are along the longer dimension of the flat base 12. The flat base 12 may have a margin 18 along the first length edge 22.

The handle 14 is connected to the flat base 12 along the margin 18.

A plurality of leaves 16 having a rectangular width equal to or less than the outer width of the flat base 12 are made from a flexible material and are flexibly attached to the flat base 12. The plurality of leaves 16 have a leaves edge 17 located approximately next to the second length edge 24 of the flat base so that the plurality of leaves 16 do not overlap into the margin 18.

The plurality of leaves 16 defines spaces between adjacent ones of the plurality of leaves 16 and are coded for a plurality of addresses for sorting mail by address by inserting individual pieces of mail between the leaves 16.

The plurality of leaves 16 are made from a flexible material so that they easily may be lifted for inserting mail between adjacent ones of the plurality of leaves. Also, the plurality of leaves are made from a flexible material so that when removing flat mail from the flat mail collator 10, the plurality of leaves 16 easily allows the mail to slip from the flat mail collator 10.

Figure 2:
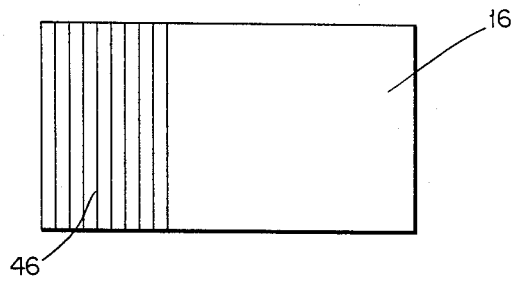
FIG. 2 shows a plastic leaf scored for being flexibly attached.

The leaves 16 are flexibly attached to the flat base 12 so that mail inserted between the leaves 16 is not clamped, and when the flat mail collator is tilted along the second length edge 24, the leaves 16 freely open allowing any mail inserted between the leaves 16 to slip from the leaves 16. For example, the leaves could be flexibly attached to the flat base 12 by using flexible yet strong material, such as duct tape. Alternatively, if some form of plastic were being used for the leaves, the plastic could be scored 46 several times as shown in FIG. 2 to achieve being flexibly attached. Further, the flat base 12 could include a plurality of ridges 66 as shown in FIG. 3, and each of the plurality of leaves 16 attached to one of the ridges 66. The ridges 66 provide built in give.

As shown in FIG. 4, underneath each of the leaves 16 is a narrow strip 76 for elevating each one of the leaves 16. The narrow strip 76 facilitates quick and easy grasping of each of the leaves during the sorting operation.

During the sorting operation, an operator will insert mail between adjacent ones of the plurality of leaves 16, which have a plurality of addresses for sorting mail by address. Upon completion of the sorting operation, the operator removes mail from the leaves 16 by lifting the flat base 12 by the handles 14 and tilting the flat base 12 along the second length edge 24 of the flat base 12. During this part of use of the flat mail collator 10, the plurality of leaves 16 will readily allow the mail inserted therein to slip from between adjacent ones of the leaves 16. Accordingly, mail which has been sorted in between the plurality of leaves 16 is allowed to slip from between the leaves 16 and remain in a sorted order.

An essential part of the present invention includes having the handles 14 attached to the margin 18 of the flat base 12. Without handles 14, a flat mail collator 10 as described herein would be very difficult to use in the manner described. Additionally, the present invention prefers having margin 18 between leaves 16 and first length edge 22, for allowing room for attaching the handles 14. Without the handles 14, the lifting operation of the flat mail collator 10 would be very difficult for an operator to perform.

The flat mail collator 10 as described herein further requires that the plurality of leaves have a rectangular shape. The rectangular shape is necessary for sorting the flat mail so that a plurality of addresses can be coded along the plurality of leaves 16. Each row of addresses can represent one mail relay or street. Each row can be color coded for facilitating identifying of a particular relay when using the flat mail correlator. Thus, by having for example, five or six color coded rows, an operator will know he is sorting in a particular mail relay based on the color. Accordingly, in a particular row the numbers or drops can be added to each leave 16. Thus an operator can go down a particular relay by color code, insert the mail by number drop, and then upon completion of the mail sorting process, allow the mail to slip from the flat mail collator 10 and be organized for mail delivery. For an entire mail route, the present invention requires that the flat mail collator have a plurality of leaves 16 with a rectangular shape so that multiple relays can be indicated as a conceptually shown in FIGS. 1A and 1B.

In operation, the collator is placed on a desk at the left most end with the collator's first length edge 2 at the closest edge of the desk. The mail to be sorted is placed at the right most edge of the desk.

Mail is sorted by finding its corresponding number on the collator, and inserting the mail between the leaves so that the mail does not cover the number on the next leaf and the bottom edge of the mail lies between midway and the bottom of the collator leaves. This placement is necessary so that the mail does not obstruct locating of numbers and the bottom edge placement is important for facilitating unloading the collator.

Once an entire street is loaded into the collator, the collator is tilted allowing the sorted mail to slip from between the leaves and remain in delivery order. The mail is gathered and bundled. This process is repeated for subsequent relays on streets until an entire route has been sorted.

A second preferred embodiment of the present invention includes having a flat mail collator 110 as shown in FIGS. 5A and 5B. This flat mail collator includes a flat base 112, first and second handle means, a plurality of leaves 116 connected to the flat base 112 and a narrow strip 122 attached near the open end of each of the leaves 116. The handle means may be embodied as first and second sets of handles 113, 114. This particular embodiment of the present invention provides for reversing the flat mail collator 110. Half of a mail route could be color coded and labeled on one side of the leaves, and the other half of the mail route on the other side of the leaves.

It will be apparent to those skilled in the art that various modifications can be made to the flat mail collator of the instant invention without departing from the scope or spirit of the invention, and it is intended that the present invention cover modifications and variations of the flat mail collator provided they come within the scope of the appended claims and their equivalents.

I claim:

1. A flat mail collator for sorting mail including magazines, newspapers and advertisement circulars or the like, comprising:

a flat base having a rectangular shape with an outer width and first and second length edges wherein first and second length edges are along the longer dimension of said flat support, said flat base having a margin along the first length edge;

handle means connected to said flat base along the margin;

a plurality of leaves having a rectangular shape with a leaves width less than the outer width of said flat base wherein the dimension of the leaves width plus the dimension of the margin approximately equals the dimension of the outer width of said flat support, said leaves being made of a flexible material and flexibly attached to said flat base for aiding in unloading said flat mail collator, and located within the outer width and having a leaves edge located approximately next to the second length edge of said flat base so that said plurality of leaves do not overlap into the margin, said plurality of leaves defining spaces between adjacent ones of said leaves and coded for a plurality of addresses for sorting mail by address by inserting individual pieces of mail between said leaves, and upon completion of the sorting operation, removing the mail from said leaves by lifting said flat base by said handle means and tilting said flat base along the second length edge of said flat base, wherein the flexibly attached leaves allow the sorted mail to slip from between said leaves and remain sorted, and a narrow strip attached near the end of each of said leaves for elevating each of said leaves slightly for facilitating lifting each of said leaves during the lifting operation.

2. A flat mail collator for sorting mail including magazines, newspapers and advertisement circulars or the like, comprising:

a flat base having a rectangular shape with an outer width and first and second length edges wherein first and second length edges are along the longer dimension of said flat support, said flat base having a margin along the first length edge;

handle means connected to said flat base along the margin and near the first length edge, for lifting said flat base from the first length edge and tilting said flat base along the second length edge;

a plurality of leaves having first and second flat surfaces and a rectangular shape, and made of a flexible material and flexibly and permanently attached to said flat base for aiding in unloading said flat mail collator, and located within the outer width and having a leaves edge located approximately next to the second length edge of said flat base, said plurality of leaves defining spaces between adjacent ones of said leaves and coded for a plurality of addresses for sorting mail by address by inserting individual pieces of mail between said leaves, and upon completion of the sorting operation, removing the mail from said leaves by lifting said flat base by said handle means and tilting said flat base along the second length edge of said flat base, wherein the flexibly attached leaves allow the sorted mail to slip from between said leaves and remain sorted, and a narrow strip attached along and projecting out from the first flat surface near the end of each of said leaves for elevating each of said leaves slightly for facilitating separating each of said leaves during the sorting and lifting functions.

3. A flat mail collator for sorting mail including magazines, newspapers and advertisement circulars or the like, comprising:

a flat base having a rectangular shape with an outer width and first and second length edges wherein first and second length edges are along the longer dimension of said flat support, said flat base having first and second margins along first and second length edges, respectively;

first handle means connected to said flat base along the first margin and near the first length edge, for lifting said flat base from the first length edge and tilting said flat base along the second length edge;

second handle means connected to said flat base along the second margin and near the second length edge, for lifting said flat base from the second length edge and tilting said flat base along the first length edge;

a plurality of leaves having first and second flat surfaces and a rectangular shape with a leaves width less than the outer width of said flat support, said leaves being made of a flexible material and permanently attached to said flat base and having a leaves edge located so that said plurality of leaves do not overlap into first and second margins, said plurality of leaves defining spaces between adjacent ones of said leaves and coded for a plurality of addresses for sorting mail by address by inserting individual pieces of mail between said leaves, and upon completion of the sorting operation, removing the mail from said leaves by lifting said flat base by said first handle means or said second handle means and tilting said flat base along the second length edge or the first length edge, respectively, of said flat base and allowing the sorted mail to slip from between said leaves and remain sorted; and a narrow strip attached along and projecting out from the first flat surface near the end of each of said leaves for elevating each of said leaves slightly for facilitating separating each of said leaves during the sorting and lifting functions.

* * * * *